United States Patent [19]

Fox

[11] 4,019,301

[45] Apr. 26, 1977

[54] CORROSION-RESISTANT ENCASEMENT FOR STRUCTURAL MEMBERS

[76] Inventor: Douglas L. Fox, 3203 Northridge Drive, Pikesville, Md. 21208

[22] Filed: Oct. 24, 1975

[21] Appl. No.: 625,871

Related U.S. Application Data

[63] Continuation of Ser. No. 488,539, July 15, 1974, abandoned, which is a continuation-in-part of Ser. No. 338,350, March 5, 1973, abandoned.

[52] U.S. Cl. ..... 52/725; 52/727; 61/54

[51] Int. Cl.[2] ..... E04C 3/34; E04C 3/30

[58] Field of Search ..... 61/54; 52/725, 731, 52/DIG. 8, 736, 727, 728, 724, 725; 264/32, 35

[56] References Cited

UNITED STATES PATENTS

| | | | |
|---|---|---|---|
| 954,973 | 4/1910 | Koetitz | 61/54 |
| 1,025,112 | 4/1912 | Davis | 61/54 |
| 1,566,582 | 12/1925 | Cortes | 61/54 |
| 1,947,413 | 2/1934 | Hay | 61/54 X |
| 2,164,108 | 6/1939 | Greulich | 61/54 |
| 2,189,028 | 2/1940 | Hansen | 61/54 |
| 2,428,070 | 9/1947 | Frenkil | 61/54 |
| 2,470,149 | 5/1949 | Derby | 61/54 |
| 2,874,548 | 2/1959 | Drushel et al. | 61/54 |
| 2,928,411 | 3/1960 | Johnson | 61/54 |
| 3,013,584 | 12/1961 | Reed et al. | 52/727 |
| 3,321,924 | 5/1967 | Liddell | 61/54 |
| 3,338,058 | 8/1967 | Young | 61/54 |
| 3,397,260 | 8/1968 | Lamberton | 61/54 X |
| 3,516,213 | 6/1970 | Sauer | 52/725 |
| 3,815,311 | 6/1974 | Nisula | 52/731 |

FOREIGN PATENTS OR APPLICATIONS

| | | | |
|---|---|---|---|
| 169,820 | 9/1934 | Switzerland | 52/728 |

OTHER PUBLICATIONS

PGH. Plate Glass Co., Splash Zone Compound, Bulletin No. 214, June 1966.

*Primary Examiner*—Ernest R. Purser
*Assistant Examiner*—Robert C. Farber
*Attorney, Agent, or Firm*—Edward F. Levy

[57] ABSTRACT

A protective system for concrete, wood and steel piling or other structures subject to corrosion or wear from the action of water. The system includes an encasement sleeve surrounding the piling or other structure and made of fiberglass, epoxy resin, or other inert, corrosion resistant material, and a filler of concrete, epoxy resin or the like between the encasement sleeve and the piling. The encasement sleeve is made of separate sections connected together by tongue and groove joints. The encasement and filler are left permanently on the structure to protect the same from water or other elements, and also to reconstruct worn portions to achieve the original structural integrity of the structure.

12 Claims, 9 Drawing Figures

CORROSION-RESISTANT ENCASEMENT FOR STRUCTURAL MEMBERS

This application is a continuation of copending application Ser. No. 488,539 filed July 15, 1974, now abandoned which was a continuation-in-part of copending application Ser. No. 338,350, filed Mar. 5, 1973 and now abandoned.

The present invention relates to construction materials, and in particular to protective encasements for constructional units to protect the latter from erosion, rust, chemical action, and the like. The protective encasements are particularly suited for the protection of pilings formed of concrete, steel or wood, to prevent the piling from corroding, pitting or otherwise deteriorating from contact of the water in which the piling is set, although the encasements may be used for protection of other members above or below water. The encasements are also effective in reconstructing the structural integrity of the pilings or other members to which they are applied.

It is well known that conventional piles, made of concrete, wood or steel, will deteriorate rapidly at the water line, even when reinforced by the use of a combination of these materials. The corrosive action of the water, particularly at the water line, causes pitting and severe wasting away of the piling by freezing, thawing, abrasion or the like. The deterioration of the piles is aggravated when the piles are set in salt water or polluted water, and are thus subjected to chemical and electrolytic action.

Existing pile systems, used to support piers or water-based structures, are constantly subjected to the deleterious action of water, and ultimately require extensive repair to retard their complete destruction. Such repair is necessarily expensive, and often is not lasting, so that the repairs must be repeated at rather frequent intervals.

In my aforementioned co-pending U.S. patent application Ser. No. 338,350, I have shown an inert corrosion-resistant system for the protection of concrete, wood and steel piling in which an inert sleeve of fibreglass, epoxy, or similar material is formed to fit around the piling and is positioned about the piling at and below the water level. In the space between the encasing sleeve and the piling a filler of epoxy grout or the like is deposited and allowed to set to complete the protective covering for the piling without the need for dewatering procedures.

In many of the applications of this corrosion-resistant system, it was necessary to pre-form the encasing sleeves to fit the shapes and sizes of different types of pilings such as H-piles or circular piles, which required a large supply of sleeves of various sizes and shapes to be fabricated and kept in stock. Further, it was often difficult to insert the closed sleeves about the body of a pile, particularly where the latter had no free end.

It is the principal object of the present invention to provide an improved encasing sleeve of the type described which is made in two or more separate sections which interfit and lock together to form a protective sleeve about piling or similar structures. The separate sections may be fitted about the piling rapidly and conveniently at any area thereon, even below the water line, and even if the piling is obstructed at both ends.

Another object of the invention is to provide an inert system for the protection of piling, sewer linings, triangular insulators for rails and other articles, which system includes a protective sleeve made of inert material and a filler of epoxy grout or similar inert material. The sleeve is formed in sections having lock joint faces for securing the sections together as a completed sleeve about the body of a selected article.

A further object of the invention is the provision of an improved, sectioned encasing sleeve of the character described in which the sections are so formed that they may be fitted together to encase articles of widely varying sizes.

In accordance with the invention herein, there is provided a protective system for structural members such as piling, said system comprising a sleeve-like encasement member sized to receive at least a portion of said structural member therein. The encasement member is formed with the same cross-sectional configuration as the structural member and is of larger size, so that the outer surfaces of the enclosed structural member are spaced from the inner surfaces of the encasement member to define a continuous gap therebetween. The system also includes a filler of inert material in said gap and filling the same, the filler bonding the encasement member to the structural member. The encasement member has a rigid body made of a chemically-inert, corrosion-resistant material such as fibreglass, the body having at least two separated facing longitudinal edges, one of which is formed with a longitudinally-extending tongue and the other of which is formed with a longitudinally-extending groove sized to receive and retain said tongue.

In a preferred form, the encasement member is formed of two or more separate sections each provided with a tongue along one of its longitudinal edges and a groove along the other of its longitudinal edges. The tongues and grooves of the sections are locked and secured together to form the completed encasement member.

Additional objects and advantages of the invention will become apparent in the course of the following specification when taken in connection with the accompanying drawings, in which.

Figure 1:
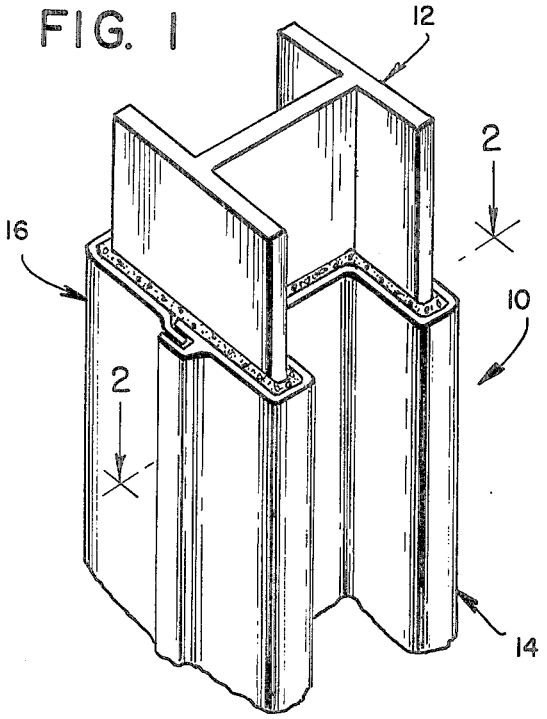
FIG. 1 is a perspective view of an H-type pile having a portion thereof surrounded by an encasement member of corresponding shape, made in accordance with the present invention.

Referring in detail to the drawings, FIG. 1 shows an encasement member 10 made in accordance with the present invention, and shaped to surround and protect an H-pile 12. The pile 12 is of the conventional type and may be formed of steel or concrete, having the H-shaped cross-section shown.

The encasement member 10 is formed of two half-sections 14 and 16, which, when fitted together, form a closed hollow shell or sleeve sized to contain the H-pile 12. The half-sections may be made of fibreglass, polyvinyl chloride, epoxies, polyesters, or other materials which are resistant to corrosion and the pitting action of water, as well as being inert to the action of chemicals. In a preferred form, the sections are made of successive layers of an epoxy resin and fibreglass cloth. The half-section 14 is formed as by molding, with pairs of spaced parallel walls 18, 20 and 22, 24 respectively connected by end walls 26 and 28 to define end channels, the walls 20 and 22 being connected at their inner ends by a transverse wall 30 constituting the central web of the section. Similarly, the half-section 16 is formed with pairs of spaced parallel walls 32, 34 and 36, 38 connected by respective end walls 40 and 42 to define end channels, the walls 34 and 36 being connected at their inner ends by a transverse wall or web 44.

Figure 2:
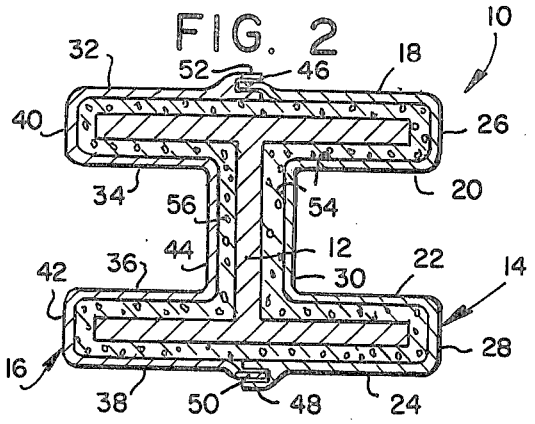
FIG. 2 is a section taken along line 2—2 of FIG. 1, and showing the gap between the H-pile and the encasement member filled with an inert filler material.

The outer wall 18 of half-section 14 is formed with an offset tongue 46 which extends the length of said wall, while the opposite outer wall 24 of half-section 14 is formed with a groove 48 extending the length thereof. In a similar manner, the outer wall 38 of half-section 16 is formed with a tongue 50 and the opposite outer wall is formed with a groove 52. When the half-sections 14 and 16 are fitted together as shown in FIGS. 1 and 2, the tongues 46 and 50 are received in the respective grooves 48 and 52, and these parts are so proportioned that the tongues fit frictionally within the grooves. In installation, the tongues are secured within the grooves with strong water-proof cement, to provide the completed encasement member 10.

Figure 3:
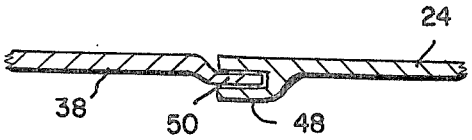
FIG. 3 is an enlarged sectional view showing the detail of one of the lock joint faces of the encasement member.

As shown most clearly in FIG. 3, each tongue 46 and 50 is bent outwardly from the plane of its associated wall, and each grooved portion 48 and 52 is also correspondingly bent outwardly. Thus when the tongue and groove are interfitted, the inner ends of the joint are flush with the inner surfaces of the walls, so as to provide a smooth, unbroken inner wall surface for the encasement member 10.

When the half-sections 14 and 16 are assembled about the piling 12 and are locked and secured together, as previously described, the assembled encasement 10 has an H-shaped cross-section conforming to the cross-section of the H-pile 12. The encasement member 10 is made larger than the H-pile 12 so that the walls of the encasement are evenly spaced from the outer surfaces of the H-pile 12, providing a continuous void or opening 54 therebetween. The void 54 may be of a width ranging from one-quarter inch to several inches.

The bottom end of the encasement member 10 is closed off by the insertion of a plug or sponge-like sealer (not shown) sized to fill the bottom of the opening 54, and an inert filler material 56 of epoxy grout or the like is poured or pumped into the opening 54 between the top of the encasement 10 and the pile 12. The filler 56 is allowed to harden, and upon solidification it adhesively connects the encasement sleeve 10 to the H-pile 12.

The filler 56 may comprise any suitable inert material which is not effected by contact with water. A concrete filler may be used for purposes of economy, but to provide a system which is more effectively resistant to corrosion, it is preferred to use a filler of hydrophobic epoxy resin such as epichlorhydrin and disphenol 2. Such material provides improved bonding of the encasement sleeve to the pile.

The encasement member 10 may be made of any suitable length and, if desired, may be cut to the same length as the pile which is to be covered. It may also be made appreciably shorter than the pile and be located in the tidal region of the water line where the pile is subject to most wear.

Figure 4:
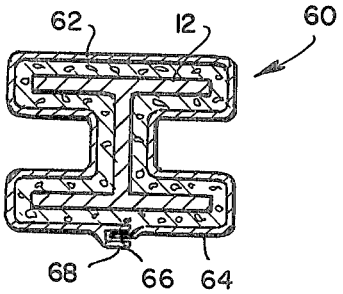
FIG. 4 is a sectional view, similar to FIG. 2, but showing a modified form of encasement member having a single lock joint face.

FIG. 4 shows an alternate embodiment of encasement member 60 which is of the same H-shaped cross-section for receiving an H-pile 12. Instead of being made of two separate half-sections, the encasement member 60 is made in one piece with an unbroken end wall 62, and with the opposite end wall 64 split longitudinally at its center. One edge of end wall 64 adjacent the split is provided with a tongue 66 and the other edge is provided with a groove 68. The split encasement 60 may be spread open for insertion about the H-pile 12, and the tongue 66 then inserted in the groove 68 and bonded therein in the manner previously described.

Figure 5:
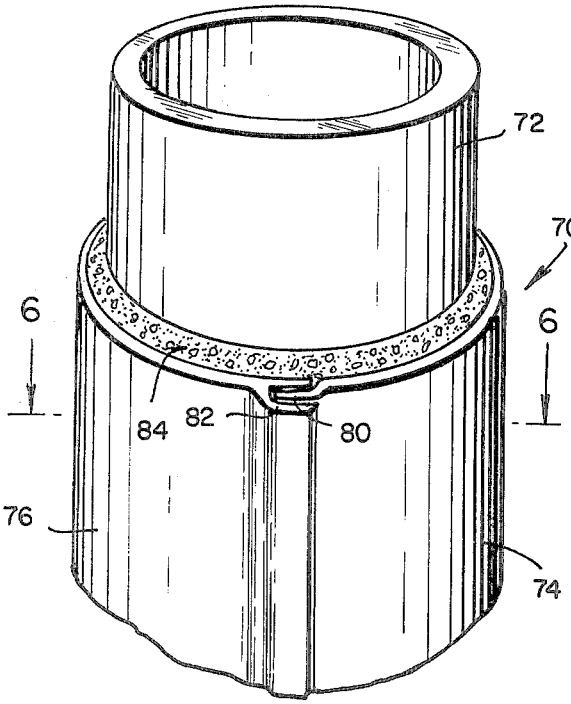
FIG. 5 is a perspective view of a circular pile having a portion thereof enclosed within an encasement member of cylindrical shape.
Figure 6:
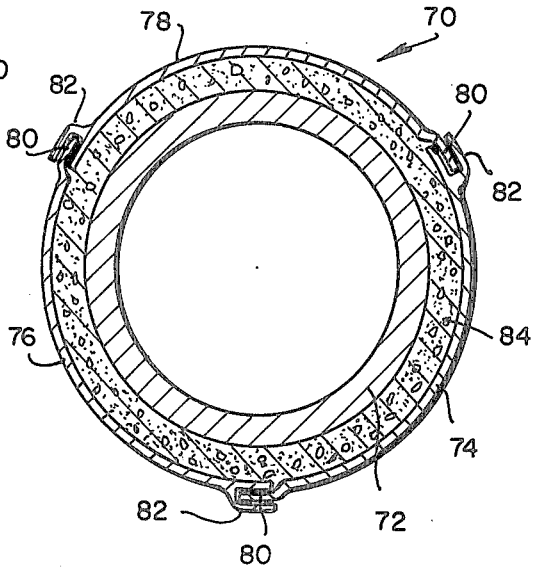
FIG. 6 is a section taken along line 6—6 of FIG. 5.

In FIGS. 5 and 6 there is shown another embodiment of encasement member 70 which is made in cylindrical form to encase a pile 72 of large diameter circular cross-section. The encasement member 70 illustrated is shown as formed of three separate sections 74, 76 and 78, although it is to be understood that the circular sleeve or shell may be formed of two sections or more than three sections, depending upon the size of the pile to be encased.

The sections 74, 76 and 78 are of identical length and each is formed with a tongue 80 along one longitudinal edge, and a groove 82 along the opposite longitudinal edge. When the sections are assembled around pile 72, the tongues 80 of each section lock within the grooves 82 of the adjacent sections and are cemented therein to provide the completed circular encasement sleeve or shell 70.

The encasement sleeve 70 is of larger diameter than the contained pile 72 so as to provide an annular space or void of a minimum of ¼ inch therebetween. Into this void is poured or pumped a filler 84 of epoxy grout or similar material to complete the protective encasement system for the pile 72. For economy purposes, a combination of epoxy and concrete may be used as the filler 84. In this instance, an initial layer of epoxy is first poured into the bottom of the sleeve 70 to a height of from 1 inch to 12 inches, then cement grout is poured into the void of sleeve 70 to a distance of 1 to 12 inches from the top of said sleeve, and finally the remainder of the void at the top of the sleeve is filled with epoxy to complete the encapsulation.

The encasement member 70 may be made of fibreglass, or any of the other inert, corrosion-resistant materials previously described in connection with the encasement 10. It will be appreciated that instead of the three sections shown, the encasement 70 may be formed of four or more sections joined together to form a sleeve or shell of larger diameter so as to fit piles or other articles of varying size.

In FIGS. 5 and 6 it will be seen that the tongues 80 are formed in such a manner that they are offset outwardly of the circumference of the sections 74, 76 and 78. In addition, the grooves 82 are so formed that the inner walls thereof are flush with the inner surfaces of the sections 74, 76 and 78, while the outer walls thereof are offset outwardly of the outer circumferential surface of the sections. Consequently, when the sections are assembled by inserting the tongues 80 into the grooves 82, the completed encasement sleeve 70 has a smooth inner surface, while the tongue and groove joints protrude from the outer surface thereof.

Figure 7:
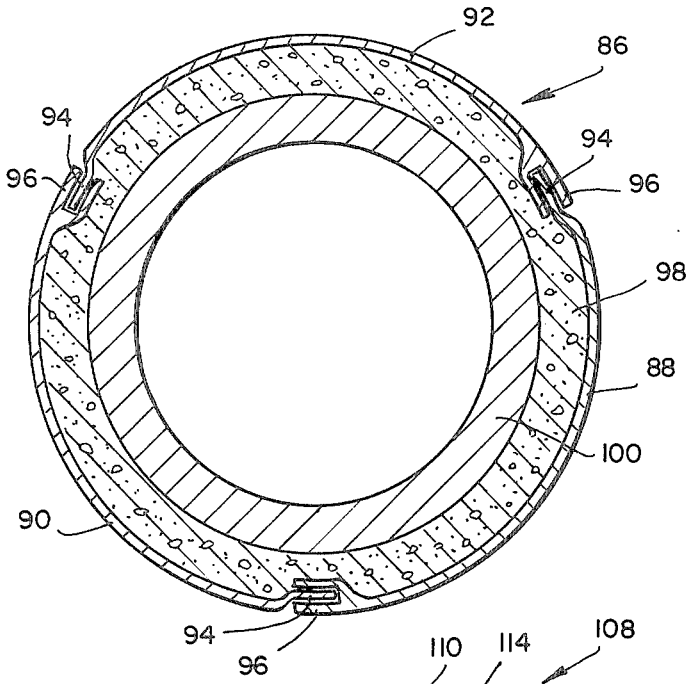
FIG. 7 is a sectional view similar to FIG. 6, but showing a modified embodiment of encasement sleeve.

FIG. 7 shows an alternative form of encasement member 86 which is identical to the encasement sleeve 70 previously described, except that the tongue and groove joints protrude inwardly from the inner surface thereof. The encasement member 86 is again formed of three separate sections 88, 90 and 92, each formed with a tongue 94 along one longitudinal edge and a groove 96 along the opposite longitudinal edge. In this instance, the tongues are each offset inwardly of the inner surfaces of their corresponding sections 88, 90 and 92, while the grooves are formed with their outer walls flush with the outer surfaces of the sections and with their inner walls offset inwardly from the inner circumferential surfaces of the sections. Thus, when the sections are assembled to form the completed encasement sleeve 86, the latter has a smooth outer surface while the tongue and groove joints protrude inwardly from the inner surface thereof. This embodiment is somewhat more difficult to manufacture, but is preferred since the inwardly projecting joints afford a much improved degree of adhesion between the encasement sleeve and the pile or other member which it surrounds. It will be appreciated that when epoxy 98 is poured into the void between the encasement sleeve 84 and the contained pile 100, the epoxy will surround the inwardly-projecting tongue and groove joints and the latter will provide effective anchoring members for securely holding the set epoxy filler and preventing slippage of the encasement sleeve relative to the contained pile. In addition, since the outer surface of the encasement sleeve 84 is smooth and the tongue and groove joints are not exposed on the outside thereof, there is no danger of the joints being rammed by boats or other large objects in the water, and being split or otherwise damaged.

Figure 8:
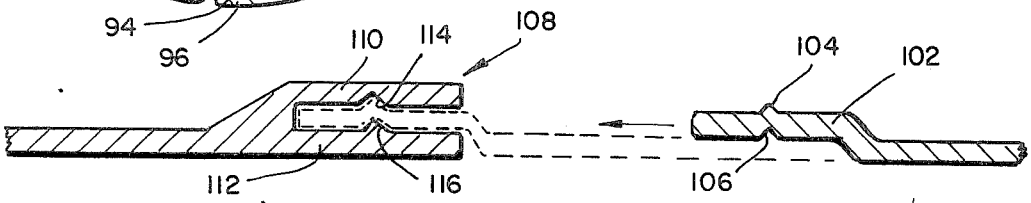
FIG. 8 is an enlarged sectional view showing a modified type of tongue and groove joint made in accordance with the invention.

FIG. 8 shows a modified form of tongue and groove joint which may be advantageously employed in any of the embodiments of encasement members shown herein. In this embodiment, the tongue 102 is molded with a rib 104 which projects from the upper surface thereof and forms a correspondingly shaped notched slot 106 on the lower surface of the tongue. The groove 108 is formed by an upper wall 110 and a lower wall 112, the upper wall 110 being molded with a notched slot 114 and the lower wall 112 being formed with a rib 116. When the tongue and groove are assembled, as shown in broken line in FIG. 8, the rib 104 of tongue 102 snaps into the slot 114 of groove wall 110, while the rib 116 of groove wall 112 snaps into the slot 106 of tongue 102. The interfitting ribs and slots aid in holding the tongue and groove joint together after it has been initially assembled, and while the epoxy cement inserted therein is setting. After the epoxy has set, the ribs and slots provide anchoring surfaces for supplementing the bond provided by the epoxy cement.

Figure 9:
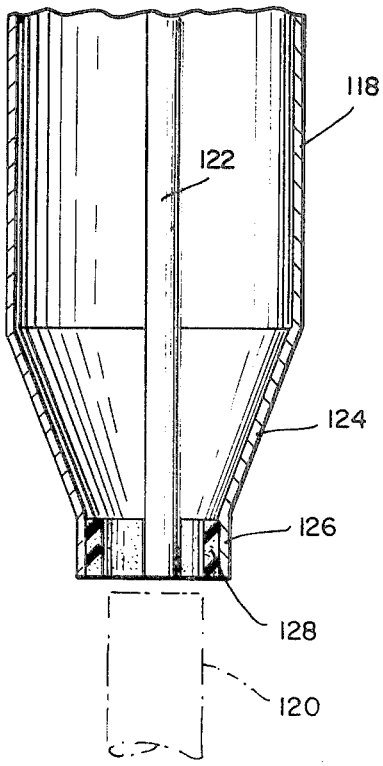
FIG. 9 is a longitudinal sectional view of a portion of encasement sleeve made in accordance with the invention and having a bottom end of decreased diameter, formed with a seal.

FIG. 9 illustrates an improved form of encasement member 118 which is constructed to provide a seal at the bottom thereof automatically when it is inserted over a pile or similar structural element. In this embodiment, the encasement member 118 is in the form of a cylindrical sleeve sized to fit upon a pile 120 of circular cross-section. The member 118 is shown made in one piece and is split longitudinally with the split edges joined by a tongue and groove joint 122 extending the length of the member 118. If desired, however, the member 118 may be made of two half-sections or of three or more sections as described above.

The encasement member 118 is formed on a mandrel which is of such configuration to provide an inwardly tapered wall portion 124 at the bottom end of the encasement member, leading to a terminal portion 126 of reduced diameter. The terminal portion 126 is sized to fit closely around the body of the pile 120. A ring 128 of foam rubber or other compressible material lines the inner surface of the terminal portion 126.

When the encasement member 118 is fitted around the pile 120 and the tongue and groove joint closed and cemented, the terminal portion 126 of reduced diameter fits closely about the body of the pile and the foam rubber ring 126 is compressed around the surface of pile 120 to provide an effective seal at the bottom of the encasement member 118. Epoxy grout may then be poured into the annular void between the encasement member 118 and the pile 120, the bottom seal holding the epoxy within the void and preventing it from flowing out of the bottom of the encasement member. The provision of this self-contained bottom seal eliminates the necessity of inserting a plug or sponge-like sealer at the bottom of an encasement member after the latter has been assembled in selected position about a pile. Lack of adequate space around the pile often makes it difficult to insert such separate sealing means.

The protective systems shown herein may be used for covering and protecting structural members other than piling. For example, sewer linings, triangular insulators for rails, and many other articles may be effectively protected against erosion, corrosion, or other deleterious action of water and chemicals. The lock joint face of the encasements shown herein permits the protective system to be easily and conveniently applied to structures in which the surrounding space is very limited, and in which the applications of protective coverings were heretofore impossible.

While preferred embodiments of the invention have been shown and described herein, it is obvious that numerous additions, changes and omissions may be made in such embodiments without departing from the spirit and scope of the invention.

What is claimed is:

1. A light-weight in situ-formed protective encasement for a structural member situated at least partially in water, and supporting a transverse load, said encasement member comprising a sheet-like jacket of reinforced resin material which is chemically inert and corrosion resistant sized to receive at least a portion of said structural member therein with at least the lower end of said encasement member located beneath the water level, said jacket having at least two separated and confronting longitudinal wall edges, and having a cross-sectional area appreciably larger than the cross sectional area of said structural member to define a continuous gap between said jacket and said structural member, said sheet-like jacket being sufficiently flexible to enable separation of said jacket at said longitudinal edge walls by a distance greater than the width of said structural member whereby to permit said jacket to be inserted transversely about said structural member in a mounted position in which said longitudinal edge walls are in overlapping relationship, said overlapping edge walls of said jacket in said mounted position being joined in situ by a sealing agent capable of curing in water, and a filler of inert bonding material filling said gap and bonding said jacket to said structural member, thereby forming with said jacket a rigid unitary encasement member as a permanent part of said structural member, said filler being made of a water insensitive resin capable of curing in water.

2. A protective encasement according to claim 1 in which said jacket has a tongue extending along one of said longitudinal edges and a groove extending along the other of said edges, said tongue being received and bonded within said groove.

3. A protective encasement according to claim 1 in which said jacket has the same cross-sectional configuration as said structural member.

4. A protective encasement according to claim 3 in which said structural member is an H-pile and said jacket has an H-shaped cross-sectional configuration.

5. A protective encasement according to claim 3 in which said structural member is a circular pile and said jacket is formed of three arcuate sections.

6. A protective encasement according to claim 1 in which said jacket is formed of fiberglass.

7. A protective encasement according to claim 1 in which said filler is an epoxy resin.

8. A protective encasement according to claim 3 in which said jacket has an integral lower portion of substantially the same cross-sectional area as said structural member, said lower body portion having a liner of compressible material engaging the outer surface of the encased structural member and providing a seal between said structural member and the lower portion of said jacket at any selected portion along the length of the jacket.

9. A method of forming a reinforcing and protective encasement about a portion of a structural member supporting a load and situated at least partially in water, comprising the steps of providing a sheet-like jacket of reinforced resin material which is chemically inert and corrosion resistant, said jacket having at least two separable longitudinal wall edges, and having a cross-sectional area appreciably larger than the cross-sectional area of said structural member, separating said jacket at said separable longitudinal wall edges and applying said jacket transversely about said structural member portion with at least the lower end of said structural member located beneath the water level, bringing said jacket to a closed position in which said longitudinal wall edges overlap and said jacket fits loosely around said structural member portion to provide a continuous gap between the inner surface of said jacket and the outer surface of said structural member, applying a seal to the bottom end of said jacket, sealing said overlapping edges with a sealant capable of setting in water, pouring into said gap a bonding composition capable of curing in water to displace the water in said gap, and allowing said bonding composition to cure and bond said jacket to said structural member, to form with said cover a permanent rigid encasement for said structural member, said encasement being free of water and constituting a structural replacement for said structural member.

10. A method according to claim 9 in which said jacket has a tongue and groove joint at said side edges, said method including the steps of separating said jacket at said side edges, placing said jacket transversely about said structural member, joining said side edges at said tongue and groove joint, and sealing said joint.

11. A method according to claim 9 in which said jacket is formed of fiberglass.

12. A method according to claim 9 in which said bonding composition includes an epoxy resin.

* * * * *

UNITED STATES PATENT OFFICE
CERTIFICATE OF CORRECTION

Patent No. 4,019,301 Dated April 26, 1977

Inventor(s) Douglas L. Fox

It is certified that error appears in the above-identified patent and that said Letters Patent are hereby corrected as shown below:

On patent face page, first Column "Related U. S. Application Data is corrected to read:

"Continuation of Ser. No. 488,539, filed July 15, 1974, abandoned, which is a continuation-in-part of Ser. No. 338,350, March 5, 1973, abandoned, which is a continuation-in-part of Ser. No. 137,867, April 27, 1971, abandoned.

Patent Column 1, lines 5-9 is corrected to read:

"This application is a continuation of copending application Ser. No. 488,539 filed July 15, 1974, now abandoned which was a continuation-in-part of copending application Ser. No. 338,350 filed March 5, 1973, now abandoned, which in turn was a continuation-in-part of copending application 137,867 filed April 27, 1971 and now abandoned."

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*